US005079120A

United States Patent [19]

Kobata et al.

[11] Patent Number: 5,079,120

[45] Date of Patent: Jan. 7, 1992

[54] LAMINATED ORGANIC PHOTOSENSITIVE MATERIAL

[75] Inventors: Tomokazu Kobata; Hisashi Izumi; Yosuke Matsui; Toshiaki Kanzaki, all of Hyogo, Japan

[73] Assignee: Bando Chemical Industries, Ltd., Kobe, Japan

[21] Appl. No.: 575,004

[22] Filed: Aug. 30, 1990

[51] Int. Cl.[5] ..... G03G 5/047

[52] U.S. Cl. ..... 430/59

[58] Field of Search ..... 430/58, 59

[56] References Cited

U.S. PATENT DOCUMENTS 4,567,126 1/1986 Emoto et al. ..... 430/59

FOREIGN PATENT DOCUMENTS 3813459 11/1988 Fed. Rep. of Germany ..... 430/59

*Primary Examiner*—Roland Martin

*Attorney, Agent, or Firm*—Wegner, Cantor, Mueller & Player

[57] ABSTRACT

A laminated organic photosensitive material which comprises an electroconductive support, a charge producing layer and a charge transporting layer formed thereon wherein the charge producing layer contains X-type nonmetal phthalocyanine as a charge producing substance and a halogen-containing resin as a binder resin for the layer, and the charge transporting layer contains a hydrazone compound of the formula:

as a charge transporting substance and a halogen-containing resin as a binder resin for the charge producing layer.

9 Claims, 2 Drawing Sheets

LAMINATED ORGANIC PHOTOSENSITIVE MATERIAL

BACKGROUND OF THE INVENTION

1. Field of the Invention

This invention relates to a laminated organic photosentive material which has a charge producing layer and a charge transporting layer formed on an electroconductive support and which has in particular a high sensitivity to a semiconductor laser region wavelength so as to be suitable for use as a photosentive material for a laser beam printer.

2. Description of the Prior Art

A composite or laminated type organic photosensitive material has been developed and put to practical use in recent years. This type of organic photosensitive material is disclosed in, for example, Japanese Patent Publications Nos. 42380/1980 and 34099/1985. It comprises an electroconductive support, and a charge producing layer and a charge transporting layer formed on the support. For instance, such a composite photosensitive material has an electroconductive support 1 of aluminum layer 2 deposited on a polyester film 3, a charge producing layer 4 formed on the aluminum layer, and a charge transporting layer 5 formed on the charge producing layer, as illustrated in FIG. 2.

The charge producing layer is formed by, for example, preparing a dispersion of a charge producing substance together with an organic solvent, a binder resin, and if necessary a plasticizer, applying the dispersion onto the support, and drying to a thin film. The charge transporting layer is formed by, for example, dissolving a charge transporting substance in an organic solvent together with a binder resin, and if required a plasticizer, applying the solution onto the charge producing layer, and drying to a thin film. A charge transporting layer may be first formed on the support, and then a charge producing layer on the charge transporting layer.

There are already known a number of laminated type organic photosensitive materials containing a variety of charge producing substances and charge transporting substances in the charge producing layer and charge transporting layer, respectively. For example, there is described in Japanese Patent Laid-Open No. 60-255854, a photosensitive material which contains a hydrazone compound represented by the formula:

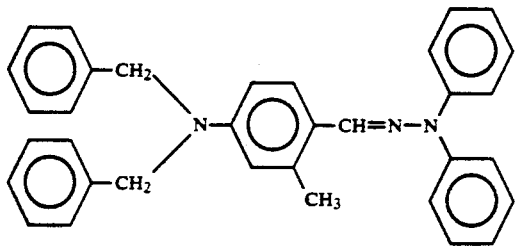

as a charge transporting substance, and a metal phthalocyanine compound such as copper phthalocyanine or a nonmetal phthalocyanine such as tetramethylphthalocyanine or dialkylaminophthalocyanine as a charge producing substance. However, these known photosensitive materials are still unsatisfactory in charging properties or sensitivity.

As above set forth, it is already known that a metal phthalocyanine and a nonmetal phthalocyanine are photoconductive, and in particular, a single layer photosensitive material which employs the X-type nonmetal phthalocyanine as a photoconductive material is disclosed in U.S. Pat. No. 3,816,118. However, this known photosensitive material has a very low sensitivity.

Meanwhile, there has been a demand for a laminated organic photosensitive material for use in a laser beam printer which is sensitive to a long wavelength region from about 750 nm to about 850 nm, and for such a purpose the use of a variety of charge producing substances and charge transporting substances have hitherto been proposed. However, any of these known laminated organic photosensitive materials which employ the beforementioned specific hydrazone compound as a charge transporting substance has a low sensitivity to a semiconductor laser region long wavelength from about 750 nm to about 850 nm.

SUMMARY OF THE INVENTION

The present inventors have made an extensive investigation to solve the problems as above set forth involved in the known laminated organic photosensitive materials, in particular to obtain a laminated organic photosensitive material having a high sensitivity to the long wavelength region of 750–850 nm. As results the inventors have found that the co-use of the aforementioned specific hydrazone compound as a charge transporting substance and X-type nonmetal phthalocyanine as a charge producing substance together with a halogen-containing resin as a binder resin for a charge producing layer provides a laminated organic photosensitive material very sensitive to the laser region long wavelength of 750–850 nm.

In accordance with the invention, there is provided a laminated organic photosensitive material which comprises an electroconductive support, a charge producing layer and a charge transporting layer formed thereon wherein the charge producing layer contains X-type nonmetal phthalocyanine as a charge producing substance and a halogen-containing resin as a binder resin for the layer, and the charge transporting layer contains a hydrazone compound of the formula:

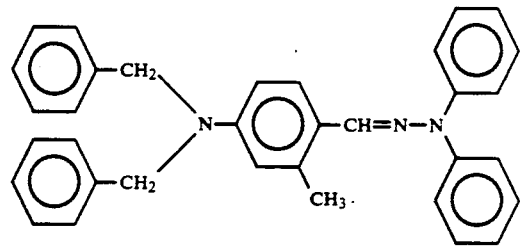

as a charge transporting substance and a halogen-containing resin as a binder resin for the charge producing layer.

Figure 1:
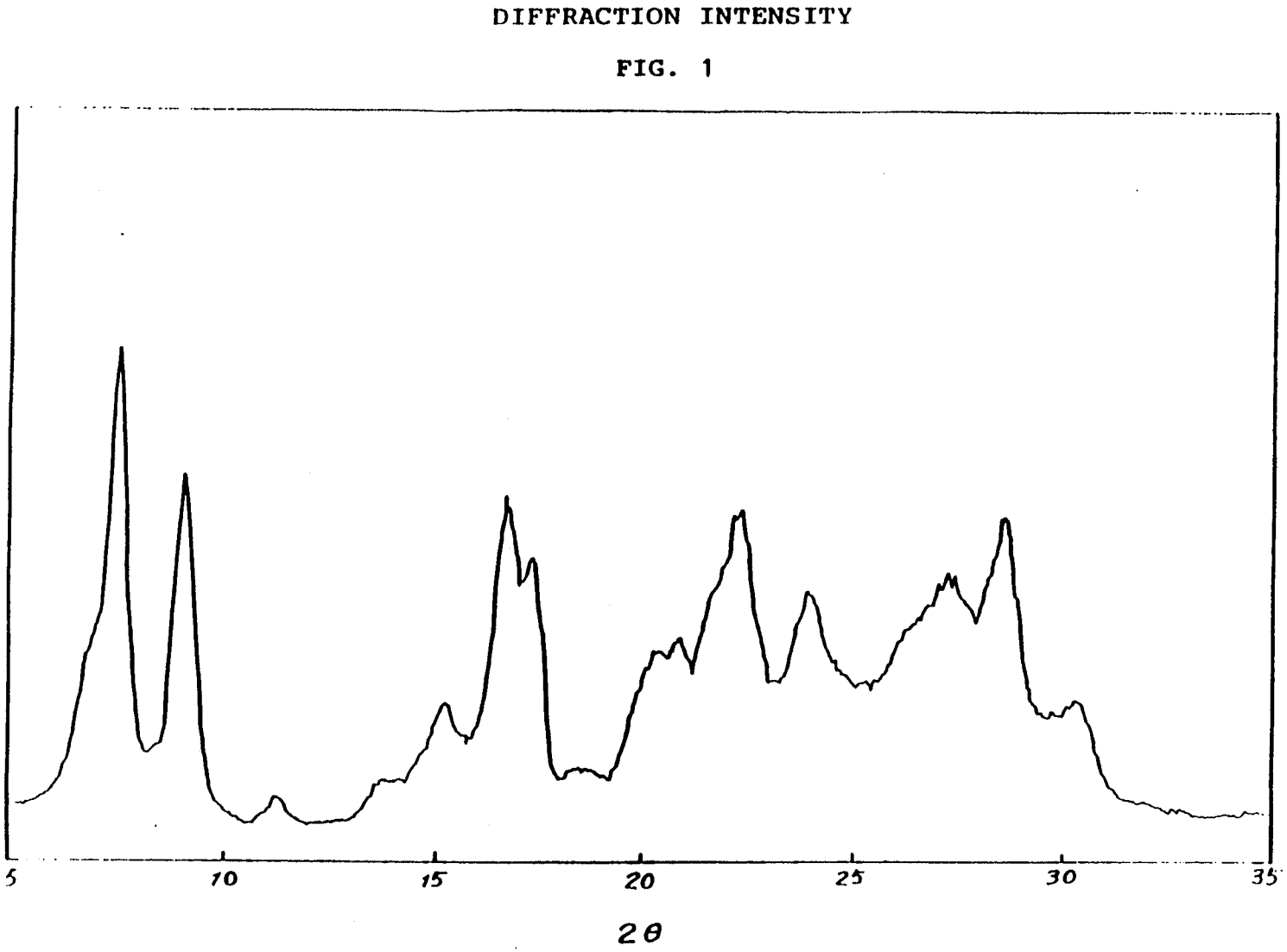
FIG. 1 is an X-ray diffraction diagram (CuK $\alpha$, powder method) of X-type nonmetal phthalocyanine used as a charge producing substance in the laminated organic photosensitive material of the invention.
Figure 2:
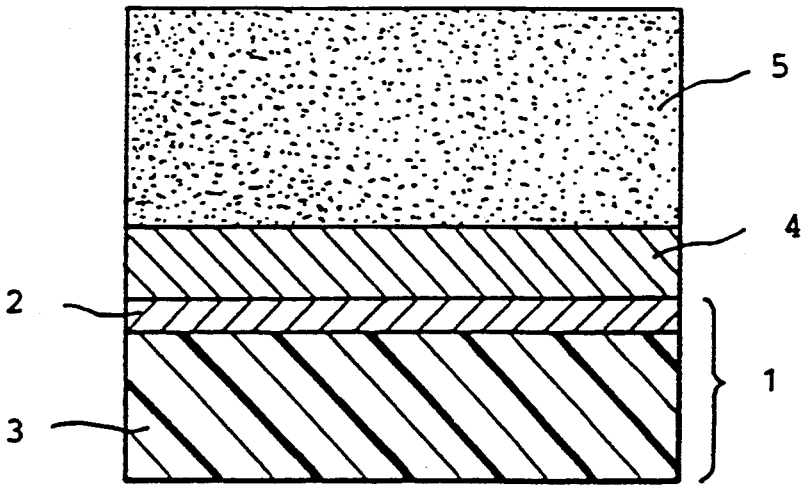
FIG. 2 is a section of a known laminated organic photosensitive material.

The laminated organic photosensitive material of the invention contains X-type nonmetal phthalocyanine as a charge producing substance. It is represented by the formula:

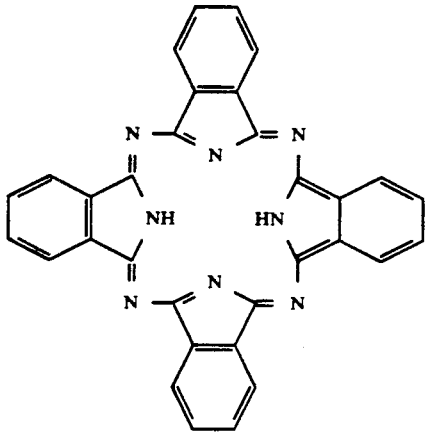

In the production of the laminated organic photosensitive material of the invention, a dispersion or a solution of the nonmetal X-type phthalocyanine as a charge producing substance, a halogen-containing polymer as a binder resin, and if necessary a plasticizer, is coated on an electroconductive support and dried to form a charge producing layer, and then a solution of the hydrazone compound as a charge transporting substance and a binder resin, and if necessary a plasticizer, is coated on the charge producing layer and dried to a form a charge transporting layer. The charge producing layer and the charge transporting layer may be laminated in the reverse order, that is, the charge transporting layer may be first formed on the support, and then the charge producing layer on the charge producing layer.

The halogen-containing resin as a binder resin for the charge producing layer is exemplified by polyvinyl chloride, vinyl chloride-vinyl acetate copolymer, ethylene-vinyl chloride copolymer or vinyl chloride-vinyl acetate-maleic anhydride copolymer. The copolymer may be a graft copolymer. When a vinyl chloride copolymer is used, it is preferred that the copolymer contains a vinyl chloride content of not less than 20% by weight.

The smaller the content of the binder resin in the charge producing layer, the better, but it is usually in the range of about 5–50% by weight based on the layer. The charge producing layer has a thickness usually of about 0.05–20 microns, preferably of 0.1–10 microns.

The charge transporting substance used in the invention is a hydrazone compound as represented by the formula hereinbefore given. The hydrazone compound is contained in the charge transporting layer usually in an amount of 10–60% by weight based on the laye, and the layer has a thickness usually of 5–100 microns.

The binder resin for the charge transporting layer is of the type which is soluble in an organic solvent and is highly compatible with the charge transporting substance so that a stable solution thereof may be prepared easily. Moreover, it is preferable to use a resin which is inexpensive and can form a film of high mechanical strength, transparency and electrical insulation. Preferred examples of the binder resin may be exemplified by, for example, polycarbonate, polystyrene, styrene-acrylonitrile copolymer, polyester resin or polyvinyl chloride.

The organic solvent used for the preparation either of the charge transporting layer or of the charge producing layer is not specifically limited, but it may include, for example, chloroform, 1,2-dichloroethane, 1,1,2,2-tetrachloroethane, tetrahydrofuran or dioxane, The invention will now be described more specifically with reference to examples, however, the invention is not limited thereto.

EXAMPLE 1

Polyvinyl chloride having an average polymerization degree of 800 (PVC-SR from Chisso K.K.) was purified by a reprecipitation method using tetrahydrofuran and n-hexane as solvents therefor and then vacuum dried.

An amount of 1.6 parts by weight of the polyvinyl chloride and 2.2 parts by weight of X-type nonmetal phthalocyanine (8120B from Dainippon Ink Kagaku Kogyo K.K.) were milled together in 96.2 parts by weight of tetrahydrofuran to prepare a dispersion.

The dispersion was applied by a doctor blade onto an aluminum film deposited on a polyethylene terephthalate film, allowed to dry at room temperature and then dried by heating at 80° C. for 60 minutes, to form a charge producing layer having a thickness of 0.6 microns.

An amount of 10 parts by weight of polycarbonate (Yupiron E-2000 from Mitsubishi Gas Kagaku Kogyo K.K.) and 8 parts by weight of the aforesaid hydrazone compound as a charge transporting substance were dissolved in 82 parts by weight of chloroform to prepare a solution. The solution was applied onto the charge producing layer by a doctor blade having a clearance of 100 microns, allowed to dry at room temperature and then dried by heating at 100° C. for 60 minutes to form a charge transporting layer having a thickness of 20 microns, whereby a laminated organic photosensitive material was obtained.

EXAMPLE 2

A laminated photosensitive material was prepared in the same manner as in the Example 1 using vinyl chloridevinyl acetate copolymer having a vinyl acetate content of 15% by weight (from Nippon Kayaku K.K.) as a binder resin for the charge producing layer.

EXAMPLE 3

A laminated photosensitive material was prepared in the same manner as in the Example 1 using vinyl chloridevinyl acetate graft copolymer having a vinyl chloride content of 50 mol % (Graftmer R-5 from Nippon Zeon K.K.) as a binder resin for the charge producing layer.

EXAMPLE 4

A laminated photosensitive material was prepared in the same manner as in the Example 1 using vinyl chloridevinyl acetate-maleic anhydride copolymer (Esleck MF-10 from Sekisui Kagaku Kogyo K.K.) as a binder resin for the charge producing layer having a thickness of 0.3 microns.

COMPARATIVE EXAMPLE 1

A laminated photosensitive material was prepared in the same manner as in the Example 1 using N,N-diethylaminobenzaldehyde diphenylhydrazone as a charge transporting substance.

COMPARATIVE EXAMPLE 2

A laminated photosensitive material was prepared in the same manner as in the Example 1 using the same polycarbonate as before mentioned as a binder resin for the charge producing layer.

COMPARATIVE EXAMPLE 3

A laminated photosensitive material was prepared in the same manner as in the Example 3 using N,N-diethylaminobenzaldehyde diphenylhydrazone as a charge transporting substance.

The laminated photosensitive materials prepared as above set forth were each evaluated for electrostatic charging characteristics by use of an electrostatic charging testing device (Model EPA 8100 from Kawaguchi Denki Seisakusho).

The surface of photosensitive material was negatively charged with a charge corona of −6 KV, and the surface potential was measured as an initial potential. Then, after the photosensitive material was left standing in the dark over a period of five seconds, the surface potential was measured as a charge retention rate.

Then the surface was irradiated at an illuminance of 5 lux with a halogen lamp, and the length of time was measured until the point at which the surface potential dropped to a half of its initial value, and the half-time exposure $E_{\frac{1}{2}}$ (lux) of the photosensitive material to that point of time was determined as its photosensitivity.

Further, the surface was irradiated with a monochromatic light having a wavelength of 750 nm and a luminous intensity of 0.5 $\mu W/cm^2$. The length of time was measured until the point at which the surface potential dropped to a half of its initial value, and the half-time exposure $E_{\frac{1}{2}}$ ($\mu J/cm^2$) of the photosensitive material to that point of time was determined as its photosensitivity.

The surface potential after five seconds from the irradiation of light was also measured as a residual potential in eiher cases above.

As the results are shown in Table 1, the photosensitive material of the invention has a small half-time exposure $E_{\frac{1}{2}}$ when irradiated with either white light or monochromatic light (750 nm), and has a high photosensitivity.

What is claimed is:

1. A laminated organic photosensitive material which comprises an electroconductive support, a charge producing layer and a charge transporting layer formed thereon wherein the charge producing layer contains X-type nonmetal phthalocyanine as a charge producing substance, and the charge transporting layer contains a hydrazone compound of the formula:

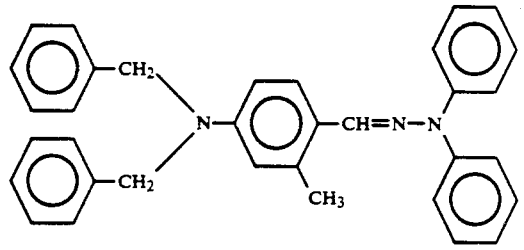

as a charge transporting substance and a halogen-containing resin as a binder resin for the charge producing layer.

2. The laminated organic photosensitive material as claimed in claim 1 wherein the halogen-containing resin is polyvinyl chloride.

3. The laminated organic photosensitive material as claimed in claim 1 wherein the halogen-containing resin is a vinyl chloride copolymer which has a vinyl chloride content of not less than 20% by weight.

4. The laminated organic photosensitive material as claimed in claim 1 wherein the charge producing layer contains the halogen-containing resin in an amount of 5–50% by weight based on the layer.

5. The laminated organic photosensitive material as claimed in claim 1 wherein the vinyl chloride copolymer is vinyl chloride-vinyl acetate copolymer.

6. The laminated organic photosensitive material as claimed in claim 1 wherein the vinyl chloride copolymer is vinyl chloride-vinyl acetate-maleic anhydride copolymer.

7. The laminated organic photosensitive material as claimed in claim 1 wherein the charge transporting layer contains the hydrazone compound in an amount of 10–60% by weight based on the layer.

8. The laminated organic photosensitive material as claimed in claim 1 wherein the charge transporting layer has a thickness of 5–100 microns.

9. The laminated organic photosensitive material as claimed in claim 1 wherein the charge producing layer has a thickness of 0.1–10 microns.

* * * * *

TABLE 1

| | Initial Potential (V) | Charge Retention Rate (%) | Half-Time Exposure $E_{\frac{1}{2}}$ White Light Sensitivity (lux · sec) | Monochromatic Light* Sensitivity ($\mu J/cm^2$) | Residual Potential (V) |
|---|---|---|---|---|---|
| Example 1 | −1068 | 85.5 | 2.6 | 0.48 | −12 |
| 2 | −1092 | 84.6 | 2.9 | 0.57 | −14 |
| 3 | −1177 | 88.9 | 3.1 | 0.62 | −21 |
| 4 | −1050 | 85.5 | 2.3 | 0.42 | −15 |
| Comparative 1 | −1008 | 91.0 | 4.2 | 1.19 | −5 |
| 2 | −1119 | 93.6 | 4.1 | 0.94 | −18 |
| 3 | −1294 | 88.6 | 4.3 | 0.97 | −128 |

*750 nm